United States Patent [19]

Schnitzler

[11] 4,064,574

[45] Dec. 27, 1977

[54] STRETCHER

[76] Inventor: Alois Schnitzler, Friesdorfer Strasse 43, D-5300 Bonn, Germany

[21] Appl. No.: 629,395

[22] Filed: Nov. 6, 1975

[30] Foreign Application Priority Data

| | | |
|---|---|---|
| Nov. 9, 1974 | Germany | 2453246 |
| Feb. 18, 1975 | Germany | 2506816 |
| Feb. 4, 1975 | Germany | 2505444 |
| Sept. 30, 1975 | Germany | 2543473 |

[51] Int. Cl.[2] ..... A47B 83/04

[52] U.S. Cl. ..... 5/82 R; 5/92; 297/388

[58] Field of Search ..... 297/388, 389; 5/82, 5/92, 317

[56] References Cited

U.S. PATENT DOCUMENTS

| | | | |
|---|---|---|---|
| 2,455,027 | 11/1948 | Thomson | 5/82 |
| 3,147,996 | 9/1964 | Ferrara et al. | 297/388 |
| 3,350,136 | 10/1967 | Allen | 297/388 |
| 3,732,863 | 5/1973 | Harrington | 5/82 |
| 3,866,250 | 2/1975 | Bradford | 5/82 |
| 3,886,606 | 6/1975 | Bradford | 5/82 |

FOREIGN PATENT DOCUMENTS

| | | | |
|---|---|---|---|
| 1,239,213 | 7/1960 | France | 297/389 |
| 565,036 | 10/1944 | United Kingdom | 5/82 |

*Primary Examiner*—Casmir A. Nunberg

*Attorney, Agent, or Firm*—Hill, Gross, Simpson, Van Santen, Steadman, Chiara & Simpson

[57] ABSTRACT

A stretcher having side strut members between which is stretched a fabric cover carries on the side struts a plurality of retractable straps. At least two of the straps are used for retaining a patient to the stretcher, at least one of the straps is a carrier strap, and one strap, at the head end of the stretcher, is useable as either a carrier strap or a holding strap. Each of the straps has a roller device affixed to one of the strut members. Each strap is carried within the automatic winding device upon a shaft which is spring biased in one direction, the shaft carrying a pawl wheel which is selectively engageable with a locking bar or lever. The locking lever is selectively positioned by an attendant to the stretcher to fix an adjustment of the strap. A free end of the strap, opposite the end retained to the shaft within the roller device is engageable either with a pin affixed to the strut of the stretcher or with a pull-pin engaged with the locking lever. One or more of the straps extend about the stretcher, with the buckle thereon being held at one side of the stretcher opposite the automatic roller device, ready for use by the attendant. The automatic wind up devices keep the straps from dragging in foreign materials when not in use. Further, the stretcher is provided with an adjustable back board for the patient, as well as with adjustable handles slideable with respect to the side struts.

23 Claims, 4 Drawing Figures

STRETCHER

BACKGROUND OF THE INVENTION

1. Field of the Invention

The invention relates to a stretcher with straps which are provided for the fastening of the patient and/or for carrier assistance.

2. The Prior Art

It is known to provide fastening straps on stretchers and wheel-chairs which serve the purpose of holding the patient thereon during transportation. German OS No. 2,108,503 shows a stretcher and French Pat. No. 2,128,991 a special stretcher for a patient having a broken backbone. The fastening straps are fastened with one end to the sides of the stretcher. At their free ends, buckles are provided which make possible a binding or connection of the free ends and an adaptation of the fastening straps to patients with varying body circumference. Upon non-use of the fastening straps, the patients must lie on the buckles, which is very bothersome. A further disadvantage of the known fastening straps has been that before and during the deposit of a patient to be strapped tight, they hang down on the side and come in contact with the ground or floor. Particularly upon use of the stretchers in accident-rescue-service, soiling of the straps readily occurs, as their ends, upon setting the stretcher on the ground, may acquire dirt, oil or blood at the place of the accident. Also the adaptation of the straps to the varying body circumferences of the different patients by means of shifting of the buckles is in many cases very difficult particularly when the straps have become wet or soiled. U.S. Pat. No. 3,817,474 and German OS No. 1,781,283 show retractable safety belts.

In the case of known stretchers, furthermore, often the stretcher bearers in carrying long distances become fatiqued and have to set down the stretcher with the patient lying thereon in order to regain their strength. The same holds true upon the transport of the ill in houses having stairs. The sick people may therefore take cold, particularly in case of unfavorable weather. Furthermore, the transportation under certain circumstances may take too long if a quick handling is of life-and-death importance. Carrier or stretcher straps are often available in ambulances, which upon fatigue of the stretcher-bearers may be laid about their necks and fastened on the stretcher, so that the transport of the sick person is physically less taxing. However, it has been found in practice that stretcher bearers leave the straps in the ambulance, so that they often are not used.

SUMMARY OF THE INVENTION

Objects of the invention include providing a stretcher for which it is not necessary to release buckles before placing a patient thereon and then to let the straps hang down and likely become soiled;

providing a stretcher in which patients not to be strapped down do not lie on the buckles of the fastening straps;

furnishing a stretcher in which fastening-and/or carrier-straps are provided which are easily actuated;

providing a stretcher with straps which may be easily attended even in poor visibility;

furnishing a stretcher having carrier-straps which are always available and cannot by inadvertence be left in the ambulance; and furnishing a stretcher in which at least one of the carrier-straps is also utilizable as fastening strap.

In accordance with the principles of the invention, a stretcher has straps for fastening the patient and/or useable as carrier straps, characterized by at least two devices which automatically roll up such straps. Each has a locking device which makes possible a stepless or continuous adjustment of the strap lengths.

DESCRIPTION OF THE PREFERRED EMBODIMENTS

Figure 1:
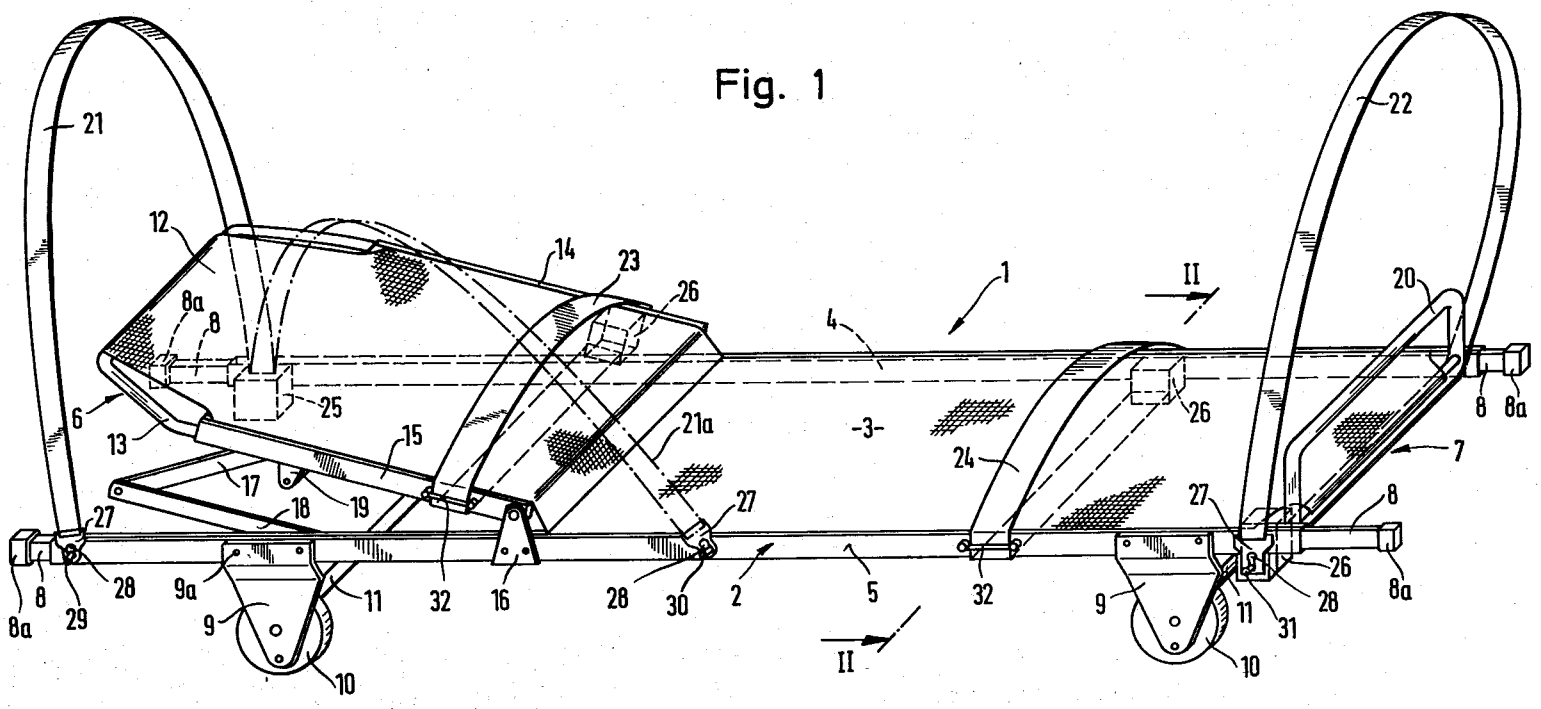
FIG. 1 shows in perspective view, partially in phantom, a stretcher according to the invention.
Figure 2:
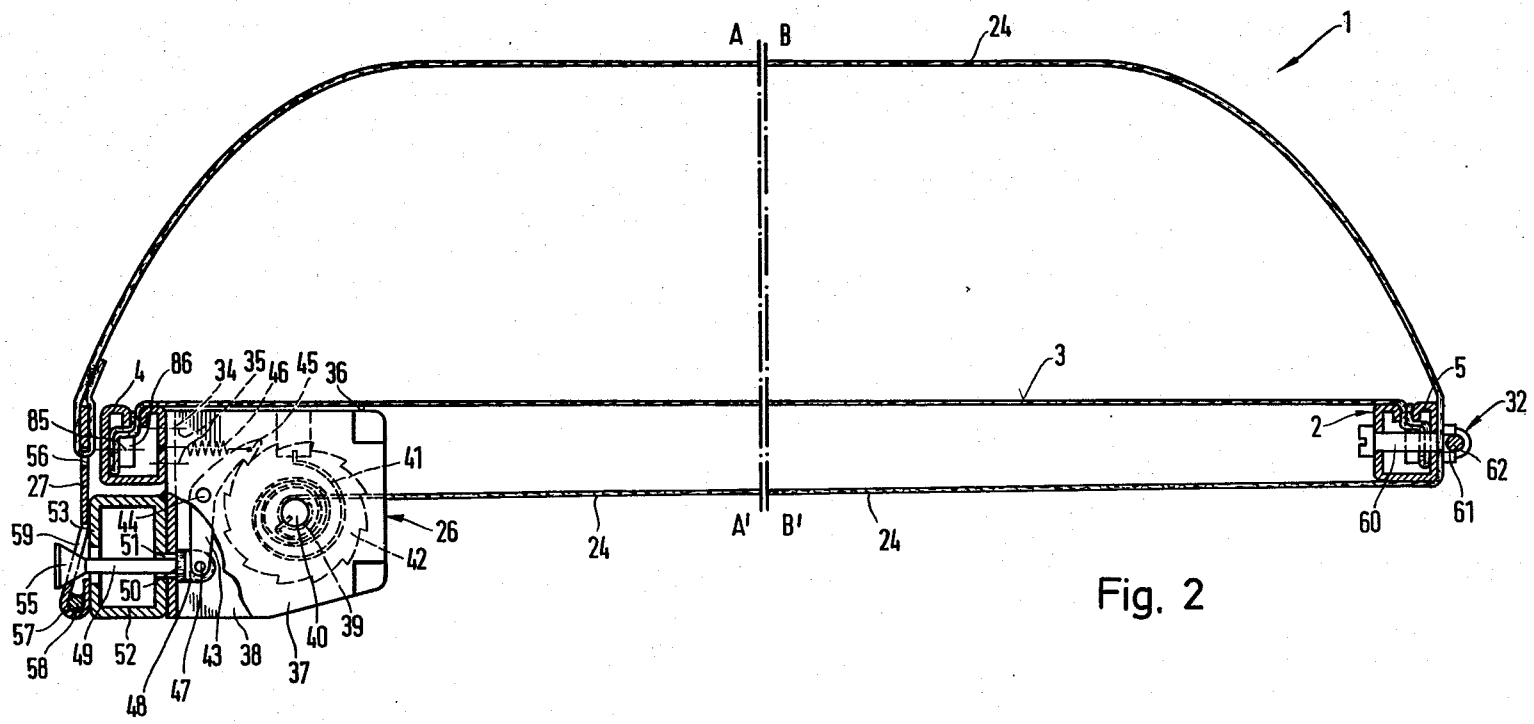
FIG. 2 shows a transverse cross-section through the stretcher along the line II—II of FIG. 1 with a first embodiment of the rolling-up-device and locking device partially broken away.
Figure 3:
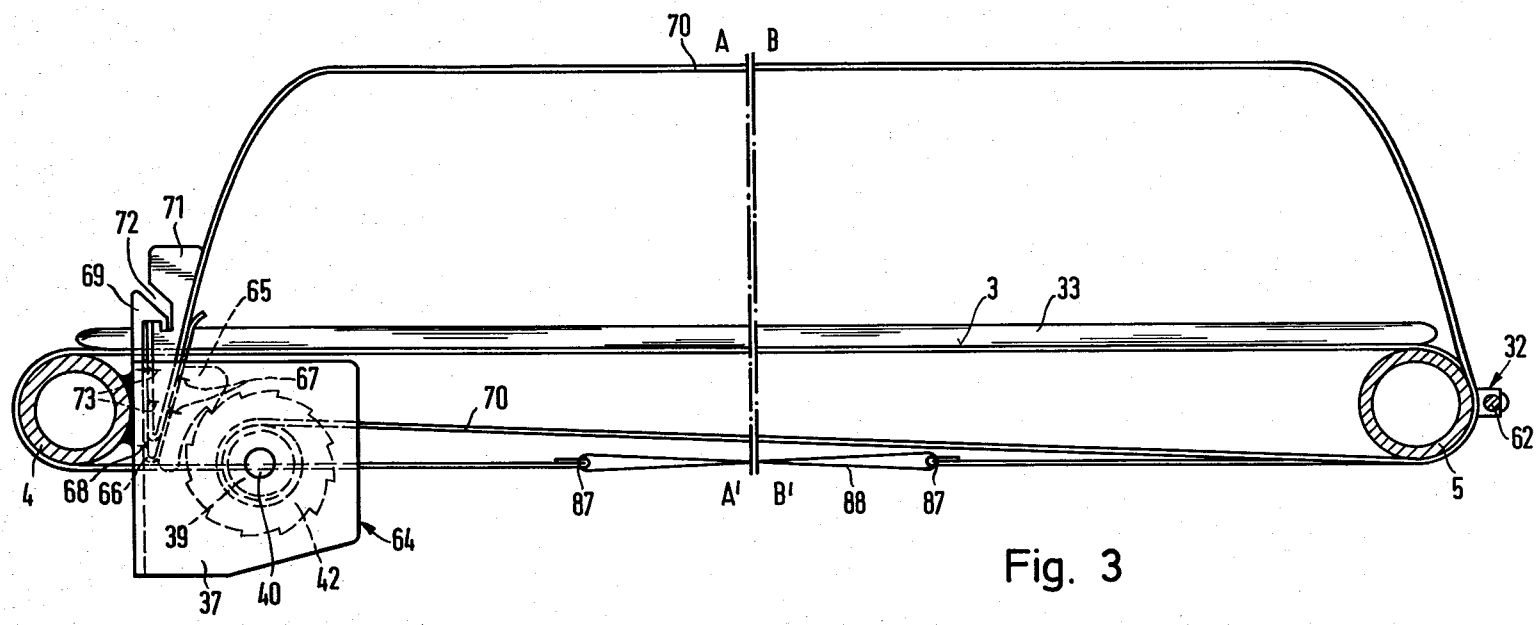
FIG. 3 shows in cross-section similar to FIG. 2 a second embodiment of the stretcher according to the invention.
Figure 4:
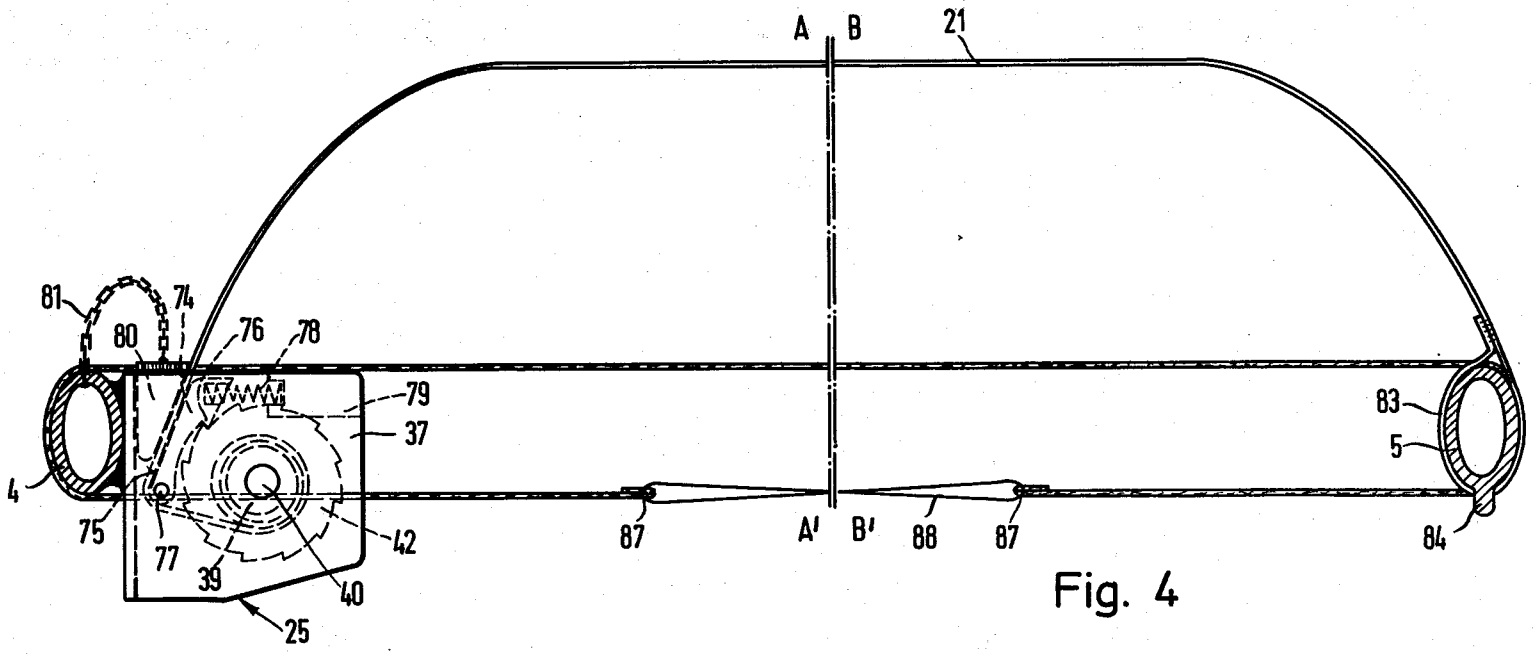
FIG. 4 shows in cross-section similar to FIGS. 2 and 3 a third embodiment of the stretcher according to the invention.

FIG. 1 shows a stretcher 1, particularly suitable for use in ambulances. The stretcher 1 consists of a frame 2, supporting thereover a cover surface 3 on which a patient is placed and carried. The surface 3 consists generally of a cloth which is fastened on the carrier frame. The carrier frame 4 consists of longitudinal struts or arms 4 and 5, which are formed of hollow tubes. The hollow tubes may have different cross-sections. In FIGS. 2, 3, and 4 the frame is shown with rectangular, circular, and oval cross-sections. At a head end 6 and at a foot end 7 of the stretcher, telescopic handles 8 are fixed in the longitudinal struts or arms 4 and 5. The handles 8 each carry at their ends a head-type closure or protecting members 8a which prevent too deep a sliding-in of the carrier handles 8 in the longitudinal struts or arms 4,5. The telescoping carrier handles 8 are further provided with stop-members, not shown, which prevent the carrier handles from being completely pulled out of the struts 4,5. On the longitudinal struts 4,5 are furthermore fixed in the area of the head-end 6 and the foot-end 7 of the stretcher downwardly-extending holding arms 9 as by rivets **9*a*. At the lower end of the holding arms 9 are disposed wheels 10 fixed on axles 11 which extend between and are supported by the pairs of holding arms 9**.

The stretcher shown in FIG. 1 also features an upwardly foldable back-rest 12 which consists of two side struts 14 and 15 connected at their ends with a bracket 13, between which struts extends a part of the cover surface 3. Lower ends of the sidestruts 14 and 15 are swingably held in connecting members 16 which are fixed upon the longitudinal struts 4 and 5. On the upwardly foldable back-rest 12 is furthermore swingably mounted a rod or stay 17 having an end which is swingably connected with an end of a second rod or stay 18. The second end of the rod or stay 18 is swingably fixed on the longitudinal strut 5. This knee-lever-type connection of the rods or stays 17 and 18, by means of a clamp-tight-mechanism, not shown, holds the upwardly-foldable back-rest 12 at any desired inclination. In the area of the upwardly foldable back-rest and the cover of the stretcher, furthermore, transverse rods are provided for reinforcement, which are connected with the longitudinal struts or the side-struts, respectively. In the drawing, only one such transverse rod or stay 19 is shown.

At the foot end 7 of the stretcher is arranged a bracket 20 between the longitudinal struts 4 and 5. The bracket 20 projects upwardly from the surface 3 and forms a foot-support for a person lying on the stretcher.

Upon the stretcher is a plurality of straps 21–24, which serve for the fastening of the patient and/or as carrier-straps. On the head end 6 of the stretcher 1 is provided a strap which serves as a carrier strap 21 or, as shown in dotted lines, as a shoulder strap 21*a*. At the foot end 7 of the stretcher is provided a further carrier strap 22. Between the two carrier straps are located two fastening straps 23 and 24. The fastening strap 23 is provided in the area of the upwardly-foldable back-rest 12 to hold a patient in the area of the upper body. The fastening strap 24 is provided near the foot end 7, where it serves for fastening the legs of the patient.

In accordance with the present invention, the carrier straps and the fastening straps are each fixed with one end engaged in an automatic wind-up device. The carrier strap 21 is fixed in the device 25, and the carrier strap 22 and the two fastening straps 23 and 24 by the devices 26. The devices 25 and 26 are each fastened on the inside of one of the longitudinal struts or arms 4 and 5 or on a side-strut 14 of the upwardly foldable back-rest 12 in such manner that its upper edge lies below the upper edge of the longitudinal strut 4 or 5 or side-strut 14 respectively, or at the same height with the cover. Thus the roll-up devices do not disturb the support of a patient on the surface 3. In the embodiment shown in FIG. 1, the roll-up devices 25 and 26 for the carrier straps 21 and 22 are fastened on either of the longitudinal struts 4 and 5. Such placement advantageously cancels any torsional moments effected by the roll-up devices about the longitudinal axis of the stretcher. The roll-up devices 25 and 26 for the holding straps 23 and 24 are arranged on the stretcher 1 as shown in FIG. 1 on the same side but it is also possible for cancellation of torsional moments between them to fasten one of these roll-up devices on each side of the stretcher.

On the free ends of the holding straps are fastened buckles 27 having tongue - like end areas with keyhole-shaped passage bores 28. The buckles 27 are engaged through the passage bores 28 with pins 29, 30 and 31 to tighten the free ends of the straps.

The strap applied at the head end of the stretcher 1 is affixed in the roll-up device 25, to which the buckle 27 returns when released from its pin 29 or 30, and the entire length of the strap is automatically wound up. The free end of the strap may, as apparent from FIG. 1, engage either the pin 29 or the pin 30 whenever an appropriate length of the belt 21 has been drawn off. When the strap, as is shown in FIG. 1 in full lines, is engaged with the pin 29, it serves as carrier strap 21 which may lie on the shoulders of a stretcher-bearer, not shown, who takes up the stretcher at the head end 6. When the free end of the strap engages the fastening device 30, it acts as shoulder strap 21*a*, which offers to a person disposed on the stretcher additional support and safety. Such use as shoulder strap 21*a* is particularly advantageous when the stretcher with a patient disposed thereon is brought into an ambulance, and subjected to various accelerations, some quite strong and also a risk exists that the ambulance may be involved in an accident. A manually actuatable locking device is used on the roll-up device 25, which is useful in adjusting the carrier strap 21. When the strap 21, as is shown at the head end 6 of the stretcher, is to be utilizable selectively as carrier strap 21 and as shoulder strap 21*a*, the roll-up device 25 has the preferred construction shown in FIG. 4.

The fastening straps 23 and 24 as well as the carrying strap 22 are brought out of the roll-up devices 25 and 26 horizontally under the cover surface 3. They travel substantially parallel to the surface 3 under the stretcher to the oppositely-disposed longitudinal strut or side-arm, respectively, at which they are in each case threaded through a strap-guide 32. The straps in use then travel over the stretcher, a supporting cushion or pillow 33 if needed (as in FIG. 3), and a person lying on the stretcher, and back to the longitudinal strut or side-strut, respectively, on which the roll-up device 26 is located. Upon non-use of the fastening straps 23 and 24 or the holding strap 22, respectively, the straps are returned upon the roller devices 26 and their free ends held in place upon the strap-guides 32. The strap-guides 32 are constructed in such manner that the strap itself may slide loosely through them, but the buckles 27 may not pass therethrough.

In the sectional views of the stretcher shown in FIGS. 2–4, a middle area is not shown between the dotted lines A,A′ and B,B′. In these drawings, therefore, the two side-areas come closer together than is actually the case.

The roll-up devices 25 and 26 used with the fastening straps 23 and 24 and for the carrier strap 22 are preferably constructed according to FIG. 2 or 3. In FIG. 2, the roll-up device 26 is attached by screws 35 to the left longitudinal strut 4 of the stretcher via an upper area of a rear-wall 34 thereof. An upper edge 36 of the roll-up device 26 is thus fixed beneath the surface 3. The roll-up device 26 has side walls 37 and 38 forming a housing open on the front side. A strap-roller 39 has an axle 40 which engages a helical spring 41 received in a spring-housing (not shown) which forms a part of the one side wall 38 of the housing. The helical spring 41 biases the strap-roller 39 in a counter-clockwise direction, so that the strap 24 is wound up. The strap-roller 39 is provided on at least one side with a pawl-wheel 42, adjacent which is arranged a locking lever 43. The locking lever 43 comprises a two-armed lever which is swingably mounted upon a swivel-pin 44 upon the side wall 37 of the roll-up device. One arm of the locking lever 43 is bent down to the pawl-wheel 42, and carries at its end a hook-shaped area 45. Upon clockwise swiveling of the locking lever 43 the hook 45 engages the teeth of the pawl-wheel 42, as shown in FIG. 2.

A tension-spring 46 engages the hook 45 at one end, the other end of the spring 46 being fixed to the rearward wall 34 of the roll-up device. The tension spring 46 acts as return-spring for the locking lever 43. The second arm of the locking lever 42 carries at its free end a pin 47 which engages an elastic connecting-member 48 consisting of rubber or an elastic synthetic material. The elastic connecting-member 48 forms the end of a pull-rod 49 having adjacent to the elastic connecting-member a collar-type-stop-member 50 The pull-rod 49 extends through an opening 51 in the rearward wall 34 of the roller device. The stop member 50 is arranged at such point on the pull-rod 49 that it abuts the wall 34 when the hook-shaped area 45 is shifted as shown in FIG. 2 so far in clockwise direction that it abuts the lowest point of a tooth of the pawl-wheel 42.

On the outer side of the rearward wall 34 is fastened in the lower area a guide part 52, for example by means of welding. The guide part 52 consists of a hollow tube with an approximately-rectangular cross-section. It has a depth of such size that its outwardly facing wall opposite the wall with which it is fixed to the rearward wall 34 of the roll-up device, projects somewhat beyond the outer edge of the longitudinal strut 4. Its outer surface 53 supports the rear side of the buckle element 27 at the end of the strap 24. Through the guide part 52 proceeds a bore which is substantially flush with the opening 51 in the wall 34. The pull-rod 49 extends through this opening and terminates outside the guide part 52 in an expanded head 55.

The end of the strap 24 forms a loop which captures a slot 56 in the upper end of the buckle 27. The buckle 27 forms at its free end a wedge-shaped closure tongue 57. The tongue 57 comprises an end of the sheet metal forming the buckle 27 bent inwardly about a pin 58. The tongue 57 has a keyhole-shaped passage-bore 59. The area with large diameter of the keyholeshaped passage bore 59 fits past the head 55 of the end of the pull-rod 49, while the narrow area of the bore 59 receives only the pull-rod and the narrower part of the head.

On the right-hand longitudinal strut 5 in the view of FIG. 2 is arranged in strap-guide 32. The strap guide 32 consists of two screws 60 passing through the longitudinal strut 5 somewhat at the spacing of the strap-width. The screws each receive a nut 61 holding one end of a guide-bar 62. In FIG. 2, the strap guide 32 is arranged on the outside on the longitudinal strut 5. A force exerted on the strap 24 is transferred to the longitudinal strut. A further advantage of this arrangement is that disposition of a cushion 33 on the stretcher is not hindered and that such cushion need not be cut out in the area of the straps. It is also possible however to fasten the strap-guides on the insides of the longitudinal struts, whereupon particularly with a rotatable embodiment of the guide-bar the friction upon the strap 24 is decreased.

When the strap 24 is not in use, the buckle 27 in the area of the right-hand longitudinal strut 5 is retained by the strap-guide 32, as it cannot pass under the guide bar 62. The tension-spring 46 holds the hook 45 of the locking lever 43 in a counterclockwise position as compared to FIG. 2, when the buckle 27 is released from the pull-rod 49, in which position the hook 45 does not engage the pawl-wheel 42. The wheel 42 is then free to rotate under the bias of the spring 41 to roll up the strap 24. A pull on the strap 24 will rotate the roller 39 in a clockwise direction, releasing portions of the strap to proceed sideways under the cover surface 3. As soon as a sufficient length of the strap-belt is removed from the roller 39 to enclose the patient and pass the buckle 27 back to the roll-up device 26, the closure tongue 57 is placed with the passage bore 59 over the head-shaped reinforcement 55. The strap is subsequently drawn upward again, so that through the wedge effect of the closure tongue 57, the pull-rod 49 is pulled to the left in FIG. 2. The locking lever 43 is moved in clockwise direction about the swivel-pin 44 until the collar-type stop member 50 abuts on the rearward wall 34. In dependence on the position taken by the strap-roller 39, the hook-shaped area 45 is pressed into a tooth-groove or at some point of a tooth surface or flank of the pawl wheel 42. The collar-shaped stop member 50 prevents too strong a force from being exerted on the locking lever 43, which could bend or deform it. The elastic connecting member 48 permits the hook 45 to abut a tip of a tooth, a tooth flank or surface besides the area of a tooth groove without undue stresses developing. The elastic member 48 also assures that upon a subsequent rotation of the strap-roller 39, the hook 45 is held into engagement with a tooth flank and is pressed into the tooth-groove. In the locking position of the roll-up device shown in FIG. 2, therefore, the strap 24 can neither be drawn off or lengthened nor a part of the same wound up. The latter is important, so that a patient during a trip is not strapped increasingly more tightly, which could cause difficulties.

FIG. 3 shows a further embodiment of a roll-up device 64, which is fastened as in the case of FIG. 2 on the left-hand longitudinal strut 4 of the carrier frame, which is shown as being a tube with circular cross-section. A part of the constructional elements of the roll-up device 64 is identical, as is developed in the roll-up device 26 shown in FIG. 2. These parts are provided with the same reference characters. The helical spring 41 is not shown to preserve clarity of the drawings. Opposite the pawl-wheel 42 is a locking lever 65 provided with a hook-shaped area. The locking lever is fixed at the free end of a V-shaped leaf-spring 66 by means of screws or rivets 67. The other end of the V-shaped leaf-spring 66 is fastened on the rearward wall 34 of the roll-up device 64, by means of screws or rivets 68. From the upper end of the rearward wall extends upwardly further a flexible hook 69 which is bent as shown.

On the right hand longitudinal strut 5 in the view of FIG. 3 is fastened a strap-guide 32, which in this case is welded to the strut 5 and consists of two projections as well as the guide-bar 62 extending between the same. At the free end of a strap 70 is fastened a closure-tongue 71 for example by means of rivets 73. The closure tongue 71 is wedge-shaped. The free strap end upon introduction of the tongue 71 into the gap formed by the V-shaped leaf spring is clamped tight about the tongue 71 within the leaf spring 66. The closure tongue 71 contains further a recess 72 formed as an undercut groove which engages and locks with the hook 69 when the closure tongue is pushed into the gap formed by the leaf spring.

Locking of the wedge-shaped closure tongue 71 moves the free end of the leaf-spring 66 in the view of FIG. 3 in clockwise direction bringing the locking lever 65 into engagement with the pawl-wheel 42. When the closure tongue 71 is removed from the leaf spring 66, upon drawing back the hook 69 from the recess 72, the leaf spring 66 springs back, whereby its free end and thereby also the locking lever 65 are swung counterclockwise in the view of FIG. 3, so that the pawl-wheel is again released and the strap-roll 39 may wind up the strap 70. Also in this embodiment, engagement or locking of the closure tongue prevents further winding or unwinding of the strap 70.

In the embodiment of FIG. 4 the roll-up device 25 is fastened on an oval longitudinal strut 4. The roll-up device 25 contains elements like the roll-up device 26 of FIG. 2, which has the same release character. The strap 21 in the winding device 25, in contrast to the embodiments described in the foregoing, is guided upwardly over the deposit surface 3 directly from the roll-up device. The strap 21 extends in this connection along the left or outer side 75 of a locking lever 74 which engages pawl-wheel 42 via a hook shaped area 76. The locking lever 74 is mounted upon a swivel pin 77 which is fixed on the side walls 37 and 38 of the roll-up device. At its oppositely disposed free end, the lever 74 receives the end area of a compression spring 78 whose other end is held in a spring cage 79.

As long as the strap 21 is drawn vertically upwardly, the compression spring 78 holds the locking lever 74 from the pawl wheel 42 so that the latter may rotate freely. An inclined pull acting on the strap 22 presses the strap on the outer surface 75 of the locking lever 74 and shifts it in a clockwise direction to the position FIG. 4, so that the hook 76 engages and locks the pawl-wheel 42. A wedge 80 is used to prevent the lever 74 from shifting out of engagement with the pawl-wheel 42 once the strap 22 has been positioned.

In the embodiment shown in FIG. 4, the strap 21 is provided solely as carrier strap, whereby its free end has a loop 83 which may be turned over the end of the longitudinal strut 5. A projection 84 on the longitudinal strut 5 prevents shifting of the loop 83.

When the strap 21 is also to be used as a shoulder strap, as this is shown in FIG. 1, instead of the loop 83 on the free end of the strap 21, a buckle 27 is applied which may be placed in fastening devices 29 or 30 projecting from the longitudinal struts.

The FIGS. 2 or 3 and 4, respectively, show furthermore two different fastening possibilities for the cover surface 3. In FIG. 2 a cloth with doubly bent-over ends is fitted into a groove extending on the upper side of the longitudinal struts or side struts and clamped tight by means of screws or rivets which pass through the side wall of the longitudinal-or-side-struts, as is indicated by the reference character 85. The screws or grooves end in clamping strips 86, so that the cloth of the surface 3 is clamped between the clamping strips 86 and the inner wall of the longitudinal or side struts.

In FIGS. 3 and 4 the cloth of the deposit surface 3 is laid around the longitudinal and side struts. The ends of the cloth are provided with eyelets 87 through which a tension cord 88 is guided crosswise. This embodiment permits simple removal of the cloth forming the cover surface for purposes of cleaning and exchange.

Although various minor modifications might be suggested by those versed in the art, it should be understood that I wish to embody within the scope of the patent warranted hereon all such modifications as reasonably and properly come within the scope of my contribution to the art.

I claim as my invention:

1. A stretcher having a pair of transversely-spaced, longitudinally-extending side struts with head and foot ends, each strut having an upper surface and portions therebelow, a cover surface stretched over and between said struts, and a plurality of strap means selectively extendable over said cover surface, wherein:

each of said strap means is retained at a first end thereof to one of said struts via a spring-biased rotatable shaft in a roll-up device and has a free end opposite said first end;

said roll-up device being affixed to said portions of said one strut below said upper surface thereof ; and each said rotatable shaft carries thereon a pawl wheel having teeth means engageable by a locking lever, said lever being biased out of engagement with said pawl wheel and being selectively positioned by an attendant to said stretcher to permit and substantially prevent said wheel and shaft from rotating and to fix a strap length adjustment.

2. A stretcher as defined in claim 1, wherein at least one of said strap means is provided at an end of said stretcher, to serve as a carrier strap for lifting said stretcher, and at least one additional of said strap means is located between said ends of said stretcher, to serve as a fastening strap.

3. A stretcher as defined in claim 2, wherein a free end of said one of said strap means is engageable with the strut opposite the strut to which its roll-up device is affixed.

4. A stretcher as defined in claim 3, wherein first and second fastening devices are provided on the stretcher strut opposite said one of said roll-up devices, said first fastening device lying transversely to said roll-up device and said second fastening device lying transversely and longitudinally of said roll-up device, whereby said strap may be used either as a carrier strap or as a shoulder strap.

5. A stretcher as defined in claim 1, wherein one of said strap means extends from its said roll-up device transversely beneath the stretcher and through a guide means affixed to said opposite strut, said guide means forming a slot receiving said strap means.

6. A stretcher as defined in claim 5, wherein a buckle attached to a free end of each said strap means is unable to pass through said strap guide, whereby the free end of the strap is prevented from returning beneath the surface to the roll-up device but further extension of the strap upwardly of the cover surface to a fastening device is possible.

7. A stretcher as defined in claim 6, wherein said strap guides are affixed to an outer side of said longitudinal strut.

8. A stretcher as defined in claim 1, wherein at least one of said struts carries releasable fastening device means for fastening the free end of a strap means.

9. A stretcher as defined in claim 1 further comprising a loop formed in one of said free ends and which is receivable over one of said longitudinal struts, and an abutment means on said strut which prevents longitudinal displacement of the loop.

10. A stretcher as defined in claim 1, wherein said roll-up devices have edges lying below a plane formed by the upper edges of the longitudinal struts.

11. A stretcher as defined in claim 1, wherein said locking lever lies between said strap means and said pawl-wheel and is pivoted at an end thereof, whereby an upward pull upon said strap releases the lever from the wheel and an inclined pull locks said lever against wheel.

12. A stretcher as defined in claim 1, wherein said locking lever is selectively positioned by engagement therewith by said free end of said strap means.

13. A stretcher as defined in claim 11, wherein said locking lever is maintained against said wheel by a wedge separately inserted into a space between said strap and a sidewall of said roll-up device.

14. A stretcher as defined in claim 1, wherein said free end of each said strap means has a wedge-shaped tongue which is engageable between said locking lever and a side of said roll-up device opposite said lever, thereby pressing said lever against said wheel.

15. A stretcher as defined in claim 14, wherein each said roll-up device has a hook means engageable with said wedge shape when said shape is engaged against said locking lever, thereby to hold said wedge in place and against said locking lever.

16. A stretcher as defined in claim 14, wherein said free strap end is fastened to the said tongue on a first side thereof, adjacent a second side which engages against said locking lever via said strap.

17. A stretcher as defined in claim 1, wherein said lever is biased by a leaf spring held stationarily at one end, and having a spring end affixed to the locking lever.

18. A stretcher as defined in claim 1, further comprising an elastic connecting member integral with a pull-rod, said member engaging said lever and displacing said lever upon engagement of an end of said pull-rod by a buckle on said free end of said strap means.

19. A stretcher as defined in claim 18, wherein said pull-rod carries at said end and enlarged head; and wherein the buckle has a wedte-shaped closure tongue formed with a keyhole-shaped passage bore whose area of large diameter is received over the enlarged portion of the head and whose area of smaller diameter can engage only the pull-rod, thereby to displace said pull-rod by action of said buckle upon engaging said head.

20. A stretcher as defined in claim 18, wherein said pull-rod has a collar engaged thereon adjacent said elastic member which abuts against said wall of said roll-up device, said stop member limiting displacement of said pull-rod.

21. A stretcher as defined in claim 18, wherein said roll-up device carries a wall spaced therefrom and against which wall said buckle engages.

22. A stretcher as defined in claim 21, wherein said wall projects laterally beyond said longitudinal strut upon which said roller device is mounted.

23. A stretcher as defined in claim 17 wherein said free strap end is fastened to a wedge shaped tongue on a first side thereof adjacent a second side which engages against said locking lever via said strap and said leaf spring.

* * * * *

UNITED STATES PATENT OFFICE

CERTIFICATE OF CORRECTION

Patent No. 4,064,574 Dated December 27, 1977

Inventor(s) Alois Schnitzler

It is certified that error appears in the above-identified patent and that said Letters Patent are hereby corrected as shown below:

Column 1, line 38, "fatiqued" should read -- fatigued --.

Column 7, lines 8 and 9, "position FIG. 4" should read -- position of FIG. 4 --.

Column 8, line 41, "have edges" should read -- have upper edges--.

Column 8, lines 47 and 48, "against wheel" should read -- against said wheel --.

Column 9, line 14, "wedte-shaped" should read -- wedge shaped --.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*